US005900121A

United States Patent [19]

Lehleiter et al.

[11] Patent Number: 5,900,121

[45] Date of Patent: May 4, 1999

[54] DOSING FEEDER FOR THE BREAST BOX OF PAPERMAKING MACHINE

[75] Inventors: Klaus Lehleiter, Wilhelmsdorf-Zussdorf; Rudolf Munch, Ravensburg, both of Germany

[73] Assignee: Voith Sulzer Papiermaschinen GmbH, Heidenheim, Germany

[21] Appl. No.: 08/826,770

[22] Filed: Apr. 7, 1997

Related U.S. Application Data

[63] Continuation of application No. 08/405,939, Mar. 17, 1995, abandoned.

[30] Foreign Application Priority Data

Mar. 18, 1994 [DE] Germany ..... 44 09 415

[51] Int. Cl.[6] ..... D21F 1/02

[52] U.S. Cl. ..... 162/322; 162/337; 162/343; 162/DIG. 12

[58] Field of Search ..... 162/138, 212, 162/258, 259, 263, 315, 322, 336, 337, 343, DIG. 11, DIG. 12

[56] References Cited

U.S. PATENT DOCUMENTS

| | | | |
|---|---|---|---|
| 1,338,094 | 4/1920 | Pope . | |
| 3,407,114 | 10/1968 | Springuel | 162/258 |
| 3,791,918 | 2/1974 | Koskimies et al. . | |
| 3,850,265 | 11/1974 | Blower et al. | 137/612.1 |
| 3,937,273 | 2/1976 | Radvan et al. | 162/322 |
| 3,970,513 | 7/1976 | Lehtinen | 162/322 |
| 4,432,835 | 2/1984 | Waris et al. | 162/336 |
| 4,539,075 | 9/1985 | Majaniemi | 162/343 |
| 4,888,094 | 12/1989 | Weisshuhn et al. . | |
| 4,897,158 | 1/1990 | Weisshuhn et al. . | |
| 4,898,643 | 2/1990 | Weisshuhn et al. . | |
| 4,909,904 | 3/1990 | Kinzler . | |

FOREIGN PATENT DOCUMENTS

| | | | |
|---|---|---|---|
| 1133791 | 10/1982 | Canada | 162/343 |
| 1236922 | 3/1967 | Germany . | |
| 2548795 | 3/1977 | Germany | 162/343 |
| 2912152 | 11/1980 | Germany . | |
| 3514554 | 3/1986 | Germany . | |
| 3639823 | 6/1988 | Germany | 162/336 |
| 3715554 | 12/1988 | Germany . | |
| 3741603 | 6/1989 | Germany . | |
| 9109313 | 7/1991 | Germany . | |
| 9205637 | 7/1992 | Germany . | |
| 4213707 | 10/1993 | Germany . | |
| 86/01844 | 3/1986 | WIPO . | |
| 88/09844 | 12/1988 | WIPO . | |
| 89/11561 | 11/1989 | WIPO . | |
| 93/22495 | 11/1993 | WIPO | 162/336 |

OTHER PUBLICATIONS

*Das Papier*, vol. 20, No. 7, Jul. 1986, pp. 313–318, D. Egelhoff, "Der Einfluss des Stoffauflaufes auf Asymmetriefehler im Papier."

*Primary Examiner*—William H. Beisner
*Attorney, Agent, or Firm*—Greenblum & Bernstein, P.L.C.

[57] ABSTRACT

Dosing feeder for the breast box of a papermaking machine. The metering device of this invention serves for the addition or the removal of fluids into or from the breast box of a papermaking machine and includes a chamber for the reception of fluids, with the chamber including a number of metering openings that are connected with the suspension-carrying parts of the breast box via throttling devices, whereby the fluid can be added or removed locally.

27 Claims, 2 Drawing Sheets

FIG. 1
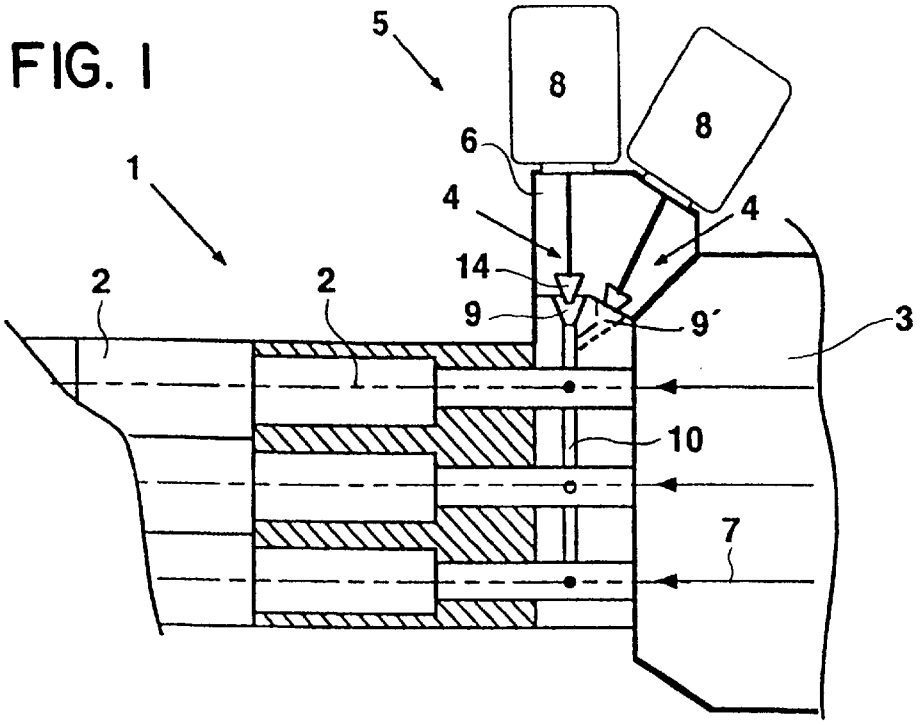
FIG. 2
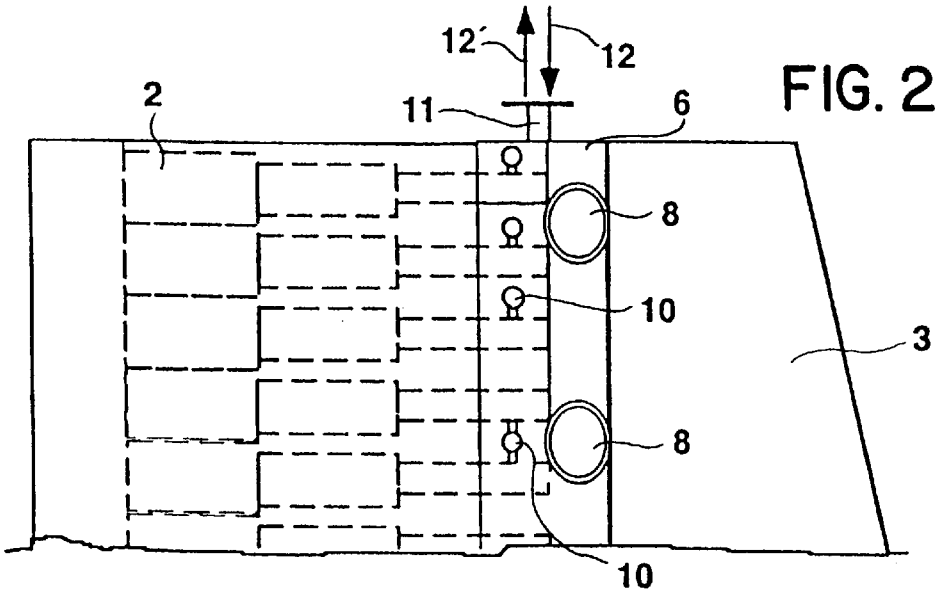
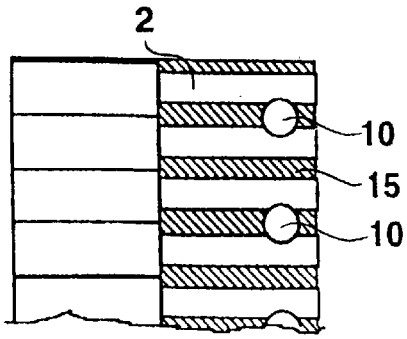
FIG. 3

DOSING FEEDER FOR THE BREAST BOX OF PAPERMAKING MACHINE

CROSS REFERENCE TO RELATED APPLICATIONS

This application is a continuation, of application No. 08/405,939, filed Mar. 17, 1995, now abandoned.

This application claims the priority of German Application No. DE-P 4409415.9, filed Mar, 18, 1994, the disclosure of which is incorporated herein by reference in its entirety.

BACKGROUND OF THE INVENTION

1. Field of the Invention

Breast boxes are normally utilized in order to produce a suspension stream or jet in a papermaking machine, which is subsequently dehydrated on a papermaking machine screen.

2. Discussion of the Background of the Invention and Material Information

In such breast boxes, a large quantity of pulp suspension is fed through the breast box. It is known, that in many instances possibilities exist via the local addition of additional liquid, particularly the addition of water or the removal of pulp suspension, to accomplish, when viewed laterally across the breast box, in individual zones, changes in the composition or the flow in the pulp suspension. Thus the quality of the produced paper sheet can be improved and controlled.

The previously-noted control possibilities are even more effective if additional points, with reference to the working width of the breast box, are available for the addition or removal of a fluid. Thus a plurality of, for example, hoses and valves must be available and assembled, which is expensive and makes the machine more subject to interruptions and adds to the confusion. Thus it is an expensive problem to produce high quality paper sheets.

It is the task of the present invention to achieve, at a lower cost than heretofore, a locally adjustable addition or removal of fluids at varying points of the breast box and, in addition, if required, to provide the highest possible number of such points for the noted addition or removal.

SUMMARY OF THE INVENTION

The task of this invention is fully achieved via a metering device for the addition or removal of fluids into or from a breast box of a papermaking machine, the metering device having at least two spaced openings arranged laterally with respect to the breast box, with each opening being connected with at least one area of the breast box through which area a paper pulp suspension flows during the operation of the papermaking machine, wherein the metering device includes at least one chamber for the reception of fluids, with the at least one chamber including several metering openings, each such opening being provided with an adjustable throttling device for throttling one of the incoming and outgoing fluids.

In a further embodiment of the metering device of this invention, the chamber extends over the entire width of the breast box and includes a multiplicity of metering openings.

In another embodiment of the metering device of this invention, the metering device includes several chambers, separated from each other, for the reception of the fluid, with the chambers being adjacently arranged when viewed across the width of the breast box.

In a differing embodiment of the metering device of this invention, the metering device includes several chambers, separated from each other, for the reception of the fluid, with the chambers being arranged in tandem when viewed over the length of the breast box.

In still a further embodiment of the metering device of this invention, adjacently located metering openings within a chamber and at least portions of the respectively associated throttling devices, when viewed in the direction of flow, are arranged in an offset manner.

Still another embodiment of the metering device of this invention further includes controllable setting motors, for the actuation of at least one throttling device each.

In still a differing embodiment of the metering device of this invention, the throttling device includes an axially adjustable, cone-shaped, sealing body, with the sealing body cooperating with a cone-shaped seat in the metering opening.

In yet a further embodiment of the metering device of this invention, the throttling device includes a rotatable sealing disc, with the outer contour of the sealing disk being is radially asymmetric relative to the turning axis thereof, with the sealing disk, relative to a metering opening, being so arranged that upon the rotation thereof, the uncovered portion of the opening is varied.

In yet another embodiment of the metering device of this invention, the throttling device includes a rotatable sealing disc having an eccentric opening relative to the turning axis thereof, with the sealing disk, relative to the associated metering opening, being so arranged that upon the rotation thereof, the uncovered portion of the opening is varied.

In yet a differing embodiment of the metering device of this invention, for a breast box, with the breast box including several flow channels for the paper pulp suspension, arranged perpendicular with respect to the stream surface and extending in the direction of the stream flow, the connection between the metering openings and at least one area of the breast box, wherein the paper pulp suspension flows during the operation thereof, takes the form of a conduit extending substantially perpendicular to the stream surface and being connected with specified flow channels.

In yet still a further embodiment of the metering device of this invention, the conduit extends between two rows of perpendicularly arranged, relative to each other, flow channels and wherein the conduit is operatively connected with at least a portion of the flow channels.

In yet still another embodiment of the metering device of this invention, the conduit takes the form of a bore in a block in one of the flow channels, in a manner so that the bore intersects the flow channels and thereby produces a fluid flow connection.

In yet still a differing embodiment of the metering device of this invention, the chamber includes a transparent wall, the latter permitting a viewing of the throttling device.

Since the addition or removal of the fluid is achieved via chambers instead of single conduits, a single connection per chamber is sufficient for the connection of the breast box with the external medium-carrying conduits. The main utilization of this invention may be the addition of a fluid having a density that varies from that of the pulp suspension, which is of the same quality over the entire area or region of the breast box. This means, that even though the amount of the added fluid depends upon the point of addition, the composition of the fluid is the same. In such cases a single chamber suffices for the entire width.

An enumerated example is the setting of the lateral cross section or the fiber orientation, in which diluting water is added via a controlled dosing or metering which varies across the width thereof. Even when the removal of a portion of the conveyed suspension in the breast box is strived for, generally a single chamber is sufficient.

It is also feasible, when viewed in the direction of the streams, to utilize several chambers in order to add varying qualities.

Generally, the actuation devices for the throttling devices are attached outside of the chamber so as to be readily accessible. They can be manually adjusted or motorized. A transport wall is quite useful for controlling the functioning of the feeding device, especially since the fluid, in many instances, is clear water.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein:

FIG. 1 a side view of a sectioned breast box utilizing a metering device in accordance with the invention;

FIG. 2 a top plan view of the metering device of this invention;

FIG. 3 sets forth specialized conduits for the fluid;

DETAILED DESCRIPTION OF THE PREFERRED EMBODIMENTS AND BEST MODE

Figure 4:
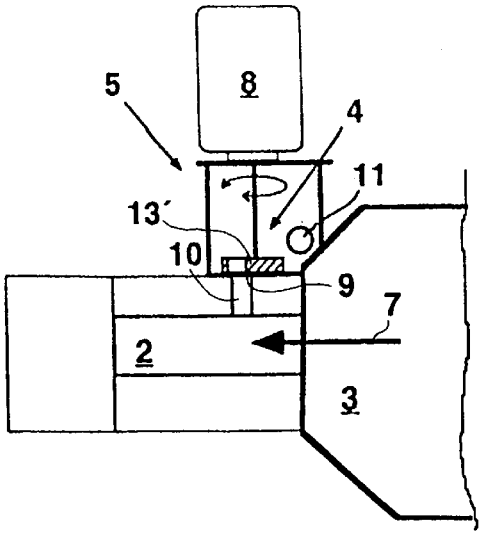
FIG. 4 is a further embodiment of the metering device of this invention.

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

FIG. 1 shows a portion of the breast box of a papermaking machine having several flow channels 2 that are perpendicularly arranged relative to the stream plane or surface. The breast box is supplied via a distribution chamber 3, from which the suspension (arrows 7) required for the paper production can enter into flow channels 2. A dosing feeder or device 5 is added to the top of the breast box and is essentially comprised of a chamber 6 and the throttling devices or flow control valves 4. Each flow control valve can be adjusted via a correspondingly arranged actuation device 8. In this manner, via dosing or metering openings 9 and 9', the fluid contained in chamber 6, can be added in desired quantities, and the suspension can be conveyed or removed from the breast box in a metered or dosed manner. The conically shaped sealing body or plug 14, shown in FIG. 1, which cooperates with a conically shaped seat in metering opening 9 and 9', requires very little space. Such a flow control device is actuated via a stroke/lowering movement or a screw movement. It should be evident that a conduit 10, emanating from metering opening 9, and which extends substantially vertically to the stream surface, provides a connection to flow channels 2.

It is entirely feasible to add the dosing feeder or device of this invention to a breast box in which the material suspension is conducted in a manner that is different than illustrated here, that is, particularly not in stepped diffusor flow channels. This is of no particular consequence as far as the advantages of the dosing device of this invention are concerned. Both single or multiple layer breast boxes can be utilized.

FIG. 2 shows a top plan view of the dosing device, again showing chamber 6, actuation devices 8 (only one of which is illustrated) for the throttling device, as well as a connection part 11, attached to chamber 6, in order to either add fluid thereto (arrow 12) or to remove suspension therefrom (arrow 12'). Since the adjacently arranged metering openings are offset relative to each other (9 and 9' in FIG. 1), actuation devices 8 can also be offset, whereby they are more easily assembled and can be serviced more readily even when the dosing or metering points are located closely adjacent to each other. Of course it is also possible to structure metering openings 9 and 9' not in an offset, but rather in an in-line manner. If desired, only actuation devices 8 and throttling devices need be angled and offset.

FIG. 2 shows flow channels 2 in broken lines and, in addition, conduit 10, together with its connection to the laterally adjacent flow channels, is also indicated.

It is shown, for example, that conduit 10 can be attached to a row of stacked flow channels or, on both sides, to two adjacent rows. The latter variation is particularly advantageous when the breast box is finely divided in many adjacent flow channels.

As shown in FIG. 3, with appropriate building proportions, conduits 10 can take the form of bores in a block or divider 15 in flow channels 2, with these boxes directly intersecting channels 2 and thereby producing very simple connections.

Figure 5A:
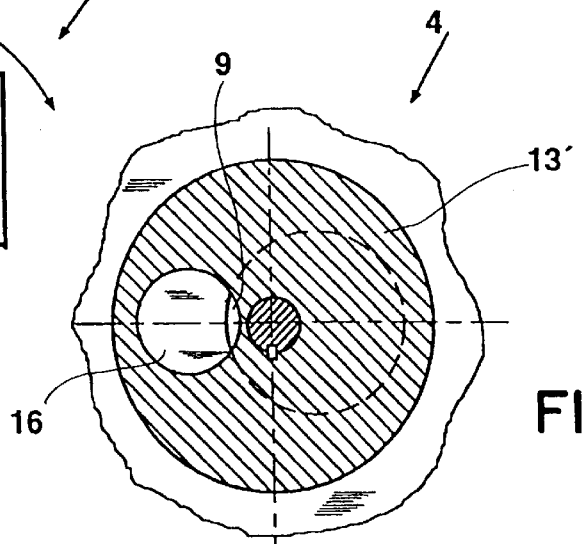
FIGS. 5*a* and 5*b* set forth details of a throttling device of this invention.
Figure 5B:
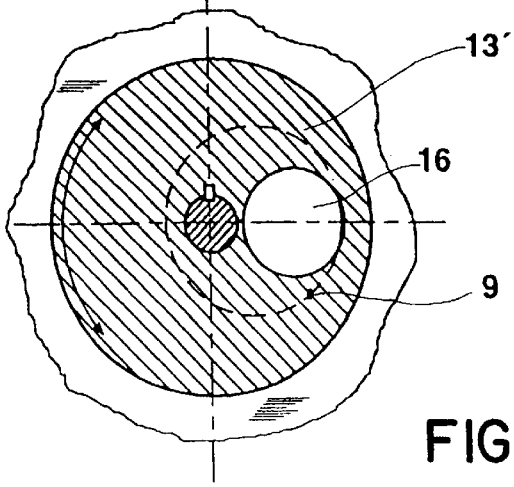

FIG. 4, which is a schematic side view of the throttling device, shows a rotatable asymmetrical sealing disk 13', whose function is explained in FIGS. 5*a* and 5*b*. Such embodiments have the advantage that the actuation of dosing device 4 is accomplished via a turning movement which, relative to setting or control motors, is less expensive than a stroke type of movement.

Very finely controlled throttling can be achieved if sealing disk 13', as illustrated in FIGS. 5*a* and 5*b*, includes an opening 16 that is eccentrically located with reference to the center of rotation of the sealing disk. Via the turning of the disk, metering opening 9 is covered to a greater or lesser extent. It can also be advantageous, independent of the setting, in all cases, to always keep a residual area open, since a continuous fluid stream will greatly reduce the danger of conduit blockage. FIG. 5*a* shows such a setting, with FIG. 5*b* showing the maximum opening.

Figure 6:
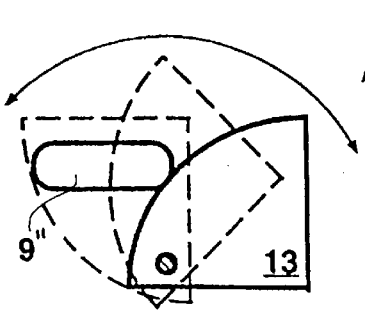
FIG. 6 sets forth details of another throttling device of this invention.

FIG. 6 shows a similar, special form of the throttling device, in which the dosing opening, for example, takes the form of an elongated aperture or hole 9" and the throttling device includes a rotatable sealing disk or plate, whose outer contour is asymmetrical with reference to the turning axis thereof, so that during the rotation thereof the open portion of elongated hole 9" can be varied.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. In combination with a breast box of a papermaking machine, a metering device for regulating addition of fluids into the breast box, said metering device comprising:

at least two spaced openings arranged laterally with respect to the breast box;

each of said at least two openings being connected with at least one separate area of the breast box;

said separate areas allowing separate portions of flow of paper pulp suspension during operation of the papermaking machine prior to introducing said paper pulp suspension to at least one turbulence generator;

at least one chamber for enabling fluid flow and including a plurality of metering openings, said at least one chamber coupled to said separate areas via said spaced openings; and each of said plurality of metering openings being provided with an adjustable throttling device for throttling the fluid flow for the addition of fluids to said separate areas to enable controlled partial mixing with the separate portions of flow of paper pulp suspension.

2. The combination of claim 1, wherein said at least one chamber extends over an entire width of the breast box.

3. The combination of claim 2, wherein adjacently located metering openings within a chamber and at least portions of the respectively associated throttling devices, when viewed in the direction of flow, are arranged in an offset manner.

4. The combination of claim 2, wherein said separate areas of the breast box are each formed by at least one flow channel, associated with each of said at least two spaced openings, for the paper pulp suspension, arranged perpendicularly with respect to a stream surface and extending in the direction of stream flow, and further including at least one conduit extending substantially perpendicularly to the stream surface and connecting said metering openings and said spaced openings with specified flow channels.

5. The combination of claim 4, wherein each said conduit includes at least two vertically spaced openings, and each said vertically spaced opening communicates with one of a plurality of vertically arranged flow channels.

6. The metering device of claim 1, wherein the metering device includes several chambers, separated from each other, for the reception of the fluid, with the chambers being adjacently arranged when viewed across the width of the breast box.

7. The combination of claim 6, wherein adjacently located metering openings within a chamber and at least portions of the respectively associated throttling devices, when viewed in the direction of flow, are arranged in an offset manner.

8. The combination of claim 6, wherein said separate areas of the breast box are each formed by at least one flow channel, associated with each of said at least two spaced openings, for the paper pulp suspension, arranged perpendicularly with respect to a stream surface and extending in the direction of stream flow, and further including at least one conduit extending substantially perpendicularly to the stream surface and connecting said metering openings and said spaced openings with specified flow channels.

9. The combination of claim 8, wherein each said conduit includes at least two vertically spaced openings, and each said vertically spaced opening communicates with one of a plurality of vertically arranged flow channels.

10. The combination of claim 1, wherein the metering device includes several chambers, separated from each other, for the reception of the fluid, with the chambers being arranged in tandem when viewed over the length of the breast box.

11. The combination of claim 10, wherein adjacently located metering openings within a chamber and at least portions of the respectively associated throttling devices, when viewed in the direction of flow, are arranged in an offset manner.

12. The combination of claim 10, wherein said separate areas of the breast box are each formed by at least one flow channel, associated with each of said at least two spaced openings, for the paper pulp suspension, arranged perpendicularly with respect to a stream surface and extending in the direction of stream flow, and further including at least one conduit extending substantially perpendicularly to the stream surface and connecting said metering openings and said spaced openings with specified flow channels.

13. The combination of claim 12, wherein each said conduit includes at least two vertically spaced openings, and each said vertically spaced opening communicates with one of a plurality of vertically arranged flow channels.

14. The combination of claim 1, wherein adjacently located metering openings within a chamber and at least portions of the respectively associated throttling devices, when viewed in the direction of flow, are arranged in an offset manner.

15. The combination of claim 1, further including controllable setting motors, for the actuation of at least one throttling device each.

16. The combination of claim 1, wherein the throttling device includes an axially adjustable, cone-shaped, sealing body, with the sealing body cooperating with a coneshaped seat in the metering opening.

17. The combination of claim 16, wherein the chamber includes a transparent wall, the latter permitting a viewing of each of said throttling devices.

18. The combination of claim 1, said throttling device includes a rotatable sealing disk including a rounded outer contour said sealing disk mounted for rotation around a turning axis, said turning axis being is radially asymmetric relative to said rounded outer contour, and said sealing disk, upon rotation relative to a respective metering opening, varying an uncovered portion of said metering opening.

19. The combination of claim 18, wherein the chamber includes a transparent wall, the latter permitting a viewing of each of said throttling devices.

20. The combination of claim 1, wherein the throttling device includes a rotatable sealing disc having an eccentric opening relative to the turning axis thereof, with the sealing disk, relative to the associated metering opening, being so arranged that upon the rotation thereof, the uncovered portion of the opening is varied.

21. The combination of claim 20, wherein the chamber includes a transparent wall, the latter permitting a viewing of each of said throttling devices.

22. The combination of claim 1, wherein said separate areas of the breast box are each formed by at least one flow channel, associated with each of said at least two spaced openings, for the paper pulp suspension, arranged perpendicularly with respect to a stream surface and extending in the direction of stream flow, and further including at least one conduit extending substantially perpendicularly to the stream surface and connecting said metering openings and said spaced openings with specified flow channels.

23. The combination of claim 22, wherein the conduit extends between two rows of perpendicularly arranged, relative to each other, flow channels and wherein the conduit is operatively connected with at least a portion of the flow channels.

24. The combination of claim 23, wherein the conduit takes the form of a bore in a block in one of the flow channels, in a manner so that the bore intersects the flow channels and thereby produces a fluid flow connection.

25. The combination of claim 22, wherein the chamber includes a transparent wall, the latter permitting a viewing of each of said throttling devices.

26. The combination of claim 22, wherein each said conduit includes at least two vertically spaced openings, and each said vertically spaced opening communicates with one of a plurality of vertically arranged flow channels.

27. The combination of claim 1, wherein the chamber includes a transparent wall, the latter permitting a viewing of each of said throttling devices.

* * * * *